US007331135B2

(12) United States Patent
Shimi

(10) Patent No.: US 7,331,135 B2
(45) Date of Patent: Feb. 19, 2008

(54) INTERNALLY ASYMMETRICAL BOLT CARRIER

(75) Inventor: Eitan Shimi, Herzliya (IL)

(73) Assignee: Israel Weapon Industries (I.W.I.) Ltd. (IL)

( * ) Notice: Subject to any disclaimer, the term of this patent is extended or adjusted under 35 U.S.C. 154(b) by 0 days.

(21) Appl. No.: 10/591,893

(22) PCT Filed: Mar. 7, 2005

(86) PCT No.: PCT/IL2005/000268

§ 371 (c)(1),
(2), (4) Date: Sep. 7, 2006

(87) PCT Pub. No.: WO2005/085742

PCT Pub. Date: Sep. 15, 2005

(65) Prior Publication Data

US 2007/0193101 A1 Aug. 23, 2007

(30) Foreign Application Priority Data

Mar. 10, 2004 (IL) ..... 160803

(51) Int. Cl.
*F41A 3/12* (2006.01)
*F41A 15/14* (2006.01)

(52) U.S. Cl. ..... 42/16; 42/25; 42/46; 89/17

(58) Field of Classification Search ..... 42/16–18, 42/20–22, 25, 26, 46; 89/17
See application file for complete search history.

(56) References Cited

U.S. PATENT DOCUMENTS

| | | | | |
|---|---|---|---|---|
| 4,398,448 | A * | 8/1983 | LaFever | 89/185 |
| 4,555,860 | A * | 12/1985 | Zedrosser | 42/25 |
| 4,653,210 | A * | 3/1987 | Poff, Jr. | 42/16 |
| 4,930,238 | A * | 6/1990 | Poff, Jr. | 42/16 |
| 5,351,598 | A * | 10/1994 | Schuetz | 89/185 |
| 5,911,173 | A * | 6/1999 | Westrom | 89/185 |
| 6,044,748 | A | 4/2000 | Westrom et al. | |
| 6,484,430 | B1 | 11/2002 | Robinson et al. | |
| 6,536,150 | B2 * | 3/2003 | Schweikart | 42/16 |
| 7,121,035 | B2 * | 10/2006 | Greer | 42/77 |
| 2002/0073591 | A1 | 6/2002 | Schweikart | |

OTHER PUBLICATIONS

International Preliminary Examination Report dated Sep. 13, 2006, for PCT/IL2005/000268, International Filing date Mar. 7, 2005.

* cited by examiner

*Primary Examiner*—Bret Hayes
(74) *Attorney, Agent, or Firm*—McDonnell Boehnen Hulbert & Berghoff LLP

(57) ABSTRACT

A bolt locking housing (16) on a gun, behind the chamber (4) thereof, for receiving a bolt (6) including an extractor (10) having an extractor hook that grips a corresponding extractor groove (21) of a cartridge (2) within said chamber (4), characterized by said bolt locking housing (16) being asymmetrically machined internally, such that there is provided at least a first protrusion (18) that becomes co-aligned with and serves to support head of extractor (10), when bolt (6) is fully closed and lugs (7) thereon are interlocked into bolt locking housing (16), thereby preventing deformation of casing of said cartridge (2) after detonation.

1 Claim, 2 Drawing Sheets

INTERNALLY ASYMMETRICAL BOLT CARRIER

FIELD OF THE INVENTION

The present invention is addressed to preventing or at least minimizing the incidence of damage to guns resulting from over pressures developed in the chamber.

BACKGROUND

Weapons with positive chamber locking are designed such that on firing the cocked gun, the bolt locks the rear part of the chamber, preventing the rupturing of the cartridge case that might otherwise result from the pressure developed by the combustion gases.

Generally, weapons with positive chamber locking are constructed to withstand pressures of 50%-60% beyond the design pressure of the relevant ammunition.

There are some instances where the pressure reaches a level of double or more the design pressure. This may be the result of blockage of the barrel due to the projectile, or in consequence of dampness or some foreign body, for example. Such a consequence may also result from use of an unsuitable propellant, or from too large a charge, i.e. too much propellant.

In these occurrences the high pressure which develops may seriously damage the weapon and may also injure the shooter or bystanders.

After activating the primer, the propellant is ignited. The burning of the propellant releases prodigious amounts of gases developing high pressures within the chamber of the gun. The high pressures which develop are isostatic, i.e. the pressure is applied equally in all directions. The bolt supports the base of the cartridge case and prevents it from deforming outwards as a result of the pressure exerted by the expanding gases. The radial pressure exerted by the gases released from the propellant forces the sides of the cartridge casing outwards and against the walls of the chamber (breech). By virtue of the retaining force applied on the cartridge casing by the walls of the chamber, the casing does not explode. The pressure generated drives the projectile down the barrel in the direction of the muzzle, allowing the conflagration gases released to expand lowering the pressure within the chamber. The cartridge case is then expelled from the breech with the help of the extractor hook.

The hook of the extractor mechanism constitutes a weak point in the wall of the chamber where the casing is not supported inflexibly. Often, the outward pressure acting on the wall of the chamber deforms the insufficiently supported cartridge casing outwards at this point, and the pressure causes the head of the extractor to be pushed outwards. This outwards movement of the extractor head allows the casing to continue to stretch under the pressure of the expanding gases, and it may rupture. The outbreak of gases in this area and the asymmetric distortion cause damage to the rifle receiver and other internal parts. Also, distorted cartridge cases may not be extracted properly and are a key cause of jamming of the firing mechanism. In extreme cases the damage may be severe enough to render the rifle unserviceable.

The present invention is directed to preventing or at least minimizing the likelihood of such failures.

SUMMARY OF THE INVENTION

In a first aspect, the present invention is directed to providing a bolt locking housing on a gun, behind the chamber thereof, for receiving a bolt including an extractor having an extractor hook that grips a corresponding extractor groove of a cartridge within said chamber; characterized by said bolt locking housing being asymmetrically machined internally, such that there is provided at least a first protrusion that becomes co-aligned with an serves to support head of extractor when bolt is fully closed and lugs thereon are interlocked into bolt locking housing, thereby preventing deformation of casing of said cartridge after detonation and allowing larger charges to be used safely, for example.

By "cartridge", as used herein, the cartridge case packed with propellant, complete with primer and bullet is intended.

By "cartridge casing" or "cartridge case", the tubular side wall of the cartridge complete with base is intended.

By "bullet" the projectile as fired from gun is intended.

By "positive locking", the interlocking of the bolt with the housing of the chamber is intended.

By "extractor groove", the annular groove machined into the cartridge case, usually just above the rim which provides a grip for the gun's extractor to pull the fired or unfired case from the chamber crimp between base of cartridge and cartridge wall is intended.

By "extractor", the device for ejecting spent cartridges from the chamber of the gun is intended.

By "extractor hook", the protrusion at the head of the extractor that engages the extractor groove of the cartridge case is intended.

DESCRIPTION OF THE FIGURES

The present invention will be further understood and appreciated from the following detailed description taken in conjunction with the drawings in which.

All Figures are annotated in a corresponding manner such that identical parts carry the same annotation number.

DESCRIPTION OF PREFERRED EMBODIMENTS

Figure 1:
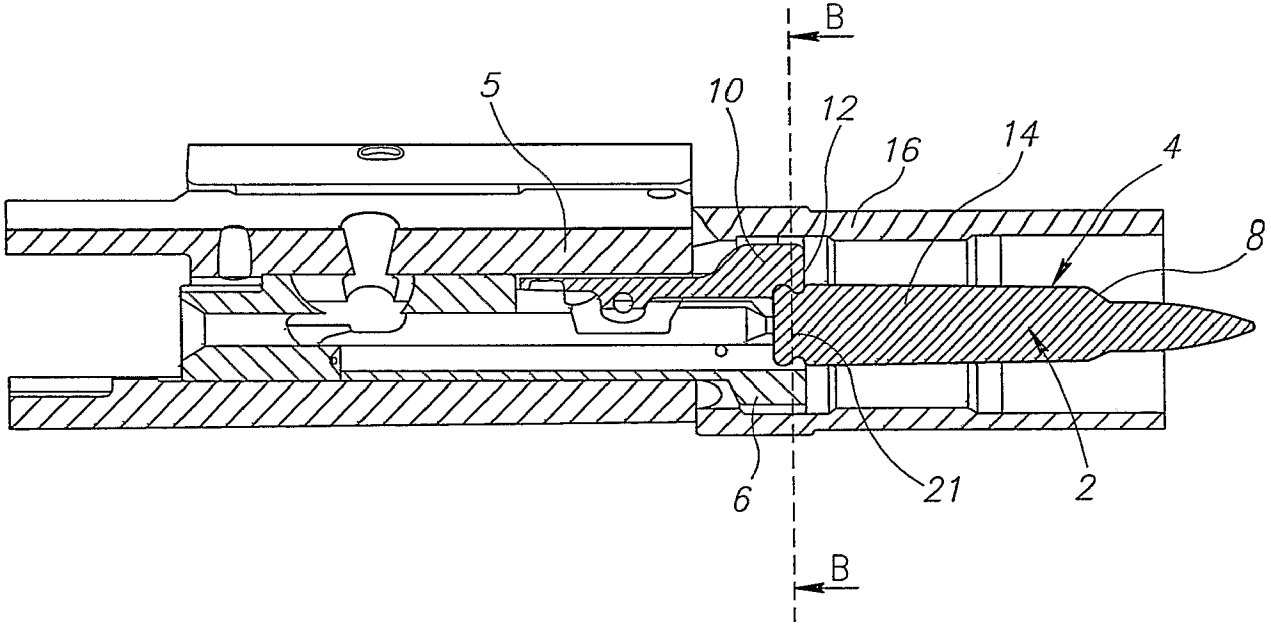
FIG. 1 is a sideways section through the chamber of one embodiment of the invention illustrating the chamber of a rifle, with a cartridge chambered therein, and the bolt contacting the primer, but prior to its locking. The extractor hook is shown engaging the extractor groove, but there is a void behind the extractor hook.

Referring to FIG. 1 in the process of feeding the cartridge 2 into the chamber 4 of a gun, the bolt 6, which is an integral part of the bolt carrier assembly 5, feeds the cartridge 2 into the firing chamber 4. With the bolt 6 in its forward position, further movement of cartridge 2 forwards is prevented by the neck 8 of the cartridge, around mouth thereof, contacting the correspondingly machined front end of the chamber 4.

The extractor hook 12 of the extractor 10 clips over the rim and clasps the extractor groove 21 of the cartridge case 14. The bolt 6 is provided with locking lugs 7 (FIG. 2), and the bolt locking housing 16 is provided with a corresponding set of locking grooves 17 (FIG. 2) that engage interlock with lugs 7 of the bolt 6 such that further forward movement of the bolt carrier assembly causes the bolt 6 to rotate, resulting in the bolt 6 being locked within bolt locking housing 16.

Figure 2:
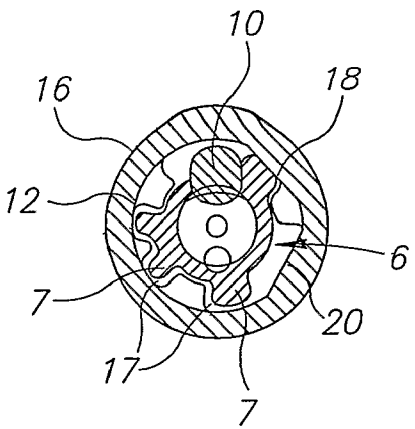
FIG. 2 is a cross section through the locking housing and the bolt head shown in FIG. 1, along B-B, the line of the extractor groove. It will be noted that the protrusion of the present invention is not aligned with the extractor head.
Figure 4:
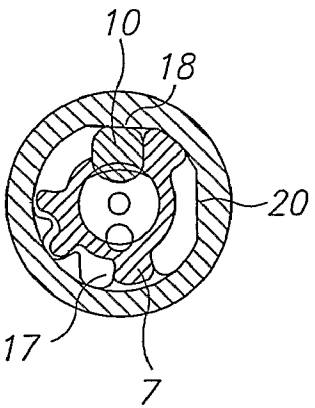
FIG. 4 is a cross section through the bolt locking housing and cartridge case in their locked position, shown in FIG. 3, along B-B, the line of the extractor groove, showing the protrusion of the present invention aligned with the extractor head.
Figure 3:
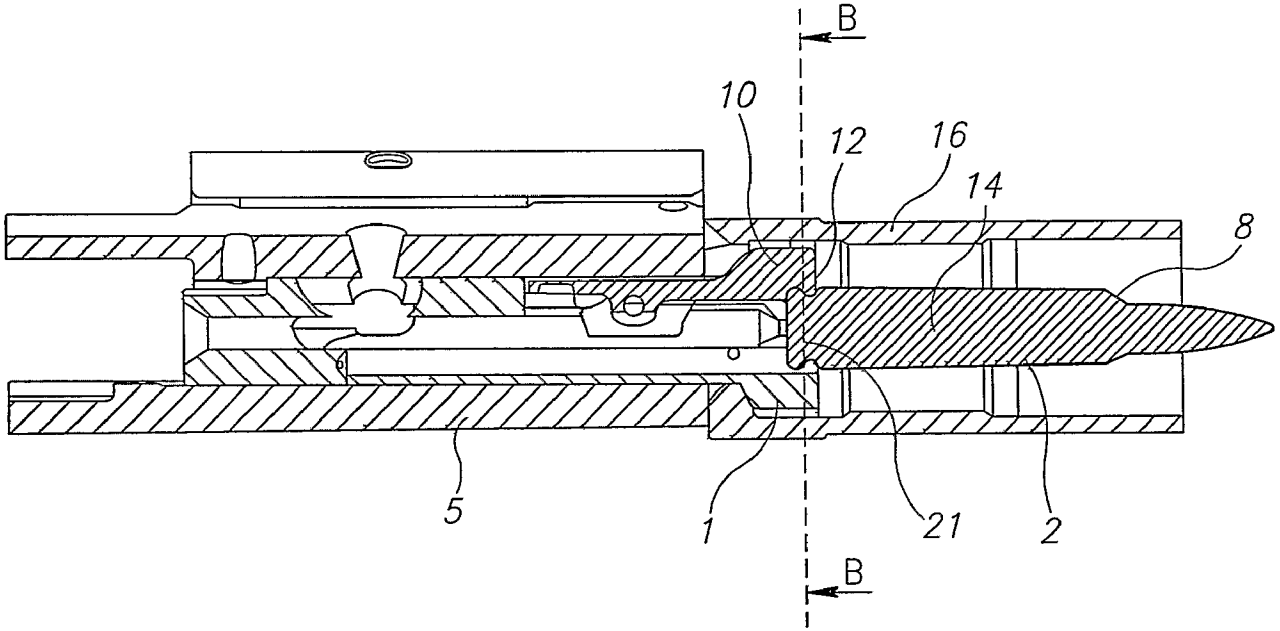
FIG. 3 is a sideways section through the bolt, chamber and extractor of the gun of FIG. 1 with a chambered cartridge, the bolt being in the locked position, with the bolt contacting the base of the cartridge case with the protrusion of the invention aligned with and reinforcing the extractor head, allowing it to resist the pressures generated by the gases released on ignition of the propellant without being deflected backwards, risking the deformation of the cartridge case.

Referring to FIG. 2, the inner surface of the bolt locking housing is non symmetrical, and has two protrusions 18, 20 thereon. Prior to the bolt being locked within the locking chamber 16, the head of the extractor 10 is not aligned with either protrusion 18, 20. However, as shown in FIGS. 3 and 4, the final rotation of the bolt 6, into its locked position, brings the head of the extractor 10 into co-alignment with one of the protrusions 18, 20. The protrusion 18, 20 acts as a backing plate to the extractor 10, reinforcing it and preventing it from being moved outwards by the force applied by the expanding gases released upon ignition of the propellant, thereby preventing the cartridge case 14 from deforming at this point of weakness, and limiting the danger of the cartridge case 14 failing at the extractor groove 21, resulting in deformation of the cartridge case 14, and the possibility of its rupturing, releasing gases at the extractor, which can damage the gun and/or risk injuring the operator thereof.

It will be appreciated that the invention is not limited to what has been described hereinabove, merely by way of example. Rather, the invention is limited solely by the claims which follow, wherein the word 'comprise', and variations thereof, such as 'comprising', 'comprised' and the like, indicate that the listed component or steps are included, but not necessary to the exclusion of other components or steps not specifically listed.

The invention claimed is:

1. A bolt locking housing on a gun, behind the chamber thereof, for receiving a bolt including an extractor having an extractor hook that grips a corresponding extractor groove of a cartridge within said chamber;

characterized by said bolt locking housing being asymmetrically machined internally, such that there is provided at least a first protrusion that becomes co-aligned with and serves to support head of extractor, when bolt is fully closed and lugs thereon are interlocked into bolt locking housing, thereby preventing deformation of casing of said cartridge after detonation.

* * * * *